United States Patent [19]

Aoki

[11] Patent Number: 4,621,539

[45] Date of Patent: Nov. 11, 1986

[54] DEVICE HAVING ROTARY KNOBS EXTENDING PARTIALLY THROUGH A PLATE MEMBER

[75] Inventor: Tsuyoshi Aoki, Miyagi, Japan

[73] Assignee: Alps Electric Co., Ltd., Japan

[21] Appl. No.: 763,084

[22] Filed: Aug. 6, 1985

Related U.S. Application Data

[62] Division of Ser. No. 278,469, Jun. 29, 1981, abandoned.

[30] Foreign Application Priority Data

Jul. 1, 1980 [JP] Japan ..... 55-92136

[51] Int. Cl.[4] ..... G05G 1/10

[52] U.S. Cl. ..... 74/553; 70/332; 70/DIG. 73; 116/282; 334/89

[58] Field of Search ..... 74/553, 10.85; 334/89; 338/319, 320, 260, 180, 128; 116/261, 321, 302, 282, 259; 70/332, 119, 21, DIG. 73, DIG. 76

[56] References Cited

U.S. PATENT DOCUMENTS

| | | | |
|---|---|---|---|
| 972,171 | 10/1910 | DuPont | 70/21 |
| 3,673,540 | 6/1972 | McDonough | 338/180 |
| 3,766,760 | 10/1973 | Wohrhauser et al. | 70/133 |
| 3,767,112 | 10/1973 | Tonari | 334/1 |
| 4,123,988 | 11/1978 | Brownlee | 116/133 |

FOREIGN PATENT DOCUMENTS

| | | | |
|---|---|---|---|
| 985398 | 3/1951 | France | 70/119 |
| 2079417 | 1/1982 | United Kingdom . | |

*Primary Examiner*—Gary L. Smith
*Assistant Examiner*—Rodney M. Lindsey
*Attorney, Agent, or Firm*—Guy W. Shoup

[57] ABSTRACT

In a device wherein electric components and rotary knobs for operating them are disposed in a case with the rotary knobs extending partially through respective slots formed in the upper surface of the case, the improvement comprising the fact that the rotary knobs are arranged in two rows and staggered with a barrier formed between the two rows.

5 Claims, 5 Drawing Figures

DEVICE HAVING ROTARY KNOBS EXTENDING PARTIALLY THROUGH A PLATE MEMBER

This is a continuation of application Ser. No. 278,469 filed June 29, 1981 now abandoned.

BACKGROUND OF THE INVENTION

The present invention relates to a device having a plurality of rotary knobs extending partially through respective slots in a plate member so as to be rotated by engaging the peripheral surface of the knobs, and more particularly, to a device in which a large number of such rotary knobs can be arranged quite closely together.

Assemblies in which a large number of electric components such as variable resistors or switches are disposed in a single case are known, and one example is a variable resistor block typically used for setting and tuning voltage of an electronically-tuned television receiver (hereinbelow, termed "tuning block").

A prior art tuning block of this type is constructed as shown in FIGS. 1 to 3. In a single case 1, a large number of variable resistors 2 are arranged together as close as possible with their longitudinal directions being parallel to one another. The variable resistors 2 are arranged equidistant from one side 1*a* of the case 1 and each include a respective operating shaft 2*a* having threads so as to move a slide element longitudinally of the resistor upon rotation. The operating shafts 2*a* are each fitted within a respective hub portion 3*a* of a rotary knob 3. The periphery of the rotary knobs 3 protrudes through respective slots 1*d* in the upper surface 1*b* of the case 1. The protruded rotary knobs 3 may be turned to operate the respective resistors by engagement with a person's finger so as to drive the variable resistor 2.

In FIGS. 1 to 3, numeral 4 indicates an insulating substrate which is mounted on the bottom of the case 1. Symbol 1*c* designates slots provided in the upper surface 1*b* of the case 1 and each having a pointer 2*b* interlocked with the slide members of the respective variable resistors 2. Terminals 2*c* of the variable resistor 2 extend through the substrate 4.

In the above construction, the rotary knobs 3 are arranged alternately in two rows with the center of each knob being aligned with the space between knobs of the other row. Such staggered relationship of the knobs 3 allows the variable resistors to be packed densely together and the whole tuning block can thus be made quite compact. Since, however, the rotary knobs 3 are arranged close together, the following drawback is prone to occur. When a desired one of the rotary knobs is being turned, the actuating finger may touch an obliquely adjoining rotary knob and turn it also, so that the preset tuning voltage of an adjoining channel is shifted.

SUMMARY OF THE INVENTION

The present invention has been made in order to eliminate the disadvantage of the prior art, and has for its object to provide a device with rotary knobs partially exposed through slots in a plate member and packed quite closely together, and yet the various knobs may be rotated without fear of operating an obliquely adjoining knob erroneously.

According to the present invention, a barrier is formed between two rows of rotary knobs. The barrier may be formed with recesses corresponding with the rotary knobs to ease operation.

BRIEF DESCRIPTION OF THE DRAWINGS

FIGS. 1 and 3 show a prior art tuning block, in which FIG. 1 is a fragmentary plan view, FIG. 2 is a fragmentary front view and FIG. 3 is a sectional side view of essential portions, and FIGS. 4 and 5 show a tuning block embodying the present invention, in which FIG. 4 is a fragmentary plan view and FIG. 5 is a perspective view of essential portions of the case thereof.

PREFERRED EMBODIMENT OF THE INVENTION

Figure 1:
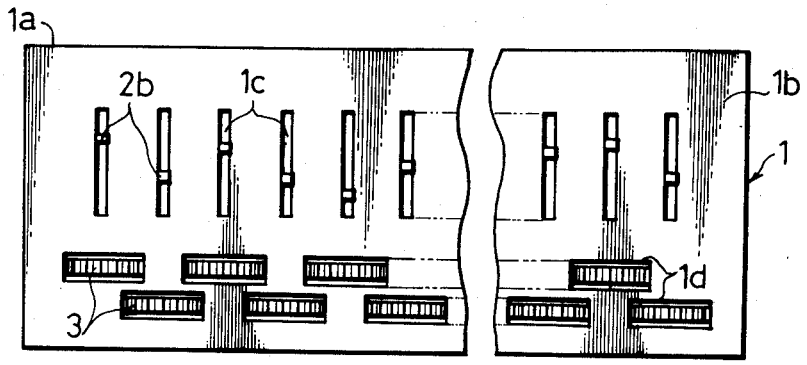
Fig. 1 PRIOR ART
Figure 2:
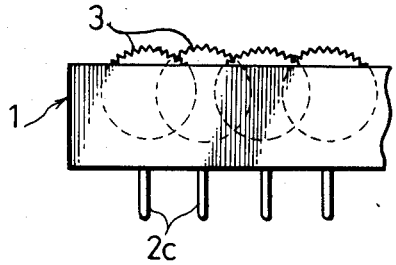
Fig. 2 PRIOR ART
Figure 3:
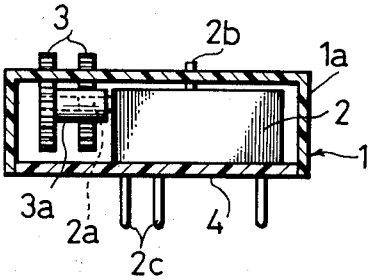
Fig. 3 PRIOR ART
Figure 4:
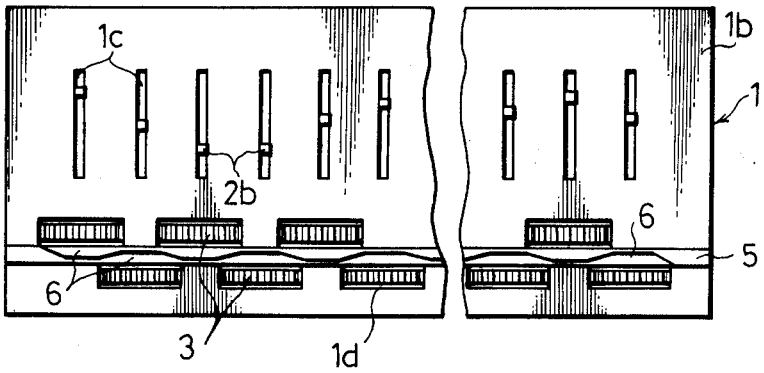
Figure 5:
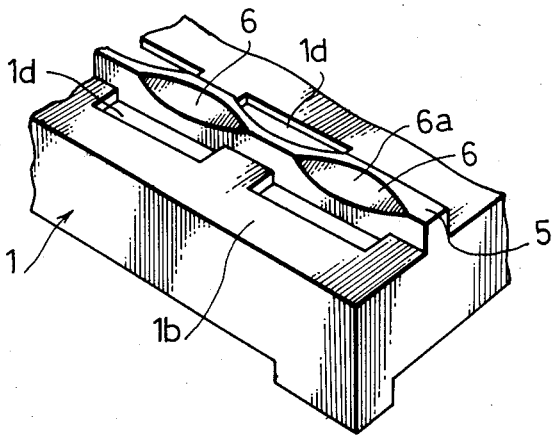

Hereunder, the present invention will be described in conjunction with an embodiment shown in FIGS. 4 and 5.

As in the prior art described above, rotary knobs 3 whose shaft portions are fitted on operating shafts of variable resistors are disposed in two rows and staggered in such a manner that their flat portions intersect orthogonally to the upper surface 1*b* of the case 1. The outer peripheries of the knobs 3 have serrations and are partly protruded through the upper surface 1*b* of the case 1. In staggering the rotary knobs 3 of the two rows, it is necessary to prepare two sorts of rotary knobs whose shaft portions have unequal lengths, but rotary knobs 3 having an identical shape may be mounted in different directions (if necessary, refer to Japanese Utility Model Application Publication No. 55-3469).

Between the two rows of the rotary knobs 3, a barrier 5 is formed integrally with the case 1. Recesses 6 having inclined surface planes 6*a* are formed in those positions of the barrier 5 which correspond to one row of the rotary knobs 3. The height of the barrier 5 is set to be substantially equal to the protrusive height of the rotary knobs 3. In some cases, however, the barrier 5 may be set to be somewhat lower than the protrusion of the rotary knobs 3 because a finger is held by the recess 6 during the operation of the rotary knob.

As set forth above, according to the present invention, in a device in which rotary knobs are disposed in two staggered rows and which is compact to take up minimum space, a barrier is formed between the two rows of the rotary knobs, so that when one of the rotary knobs is operated, an obliquely adjoining rotary knob may not be erroneously operated. Recesses may be provided in the barrier to hold a finger, and the fear of erroneous operation is further reduced. Moreover, a sense of security is given during operation, and the feel during operation is excellent.

Needless to say, the height and width of the barrier and the shape of the recess can be somewhat modified within a scope of the appended claims and not departing from the spirit of the present invention. As electric components on which the rotary knobs are mounted, rotary type digital switches or the like may also be used in addition to the variable resistors referred to previously.

What is claimed is:

1. In a structure having a plurality of rotary knobs extending partially through respective slots in a plate member for operator manipulation with a finger, each rotary knob being adapted to operate a respective electric component, the improvement wherein the plurality of rotary knobs are arranged in at least two parallel rows spaced closely adjacent each other, the rotary knobs in each row being spaced apart from each other and aligned parallel in one plane, the rotary knobs of one row being staggered so as to be laterally offset with respect to the rotary knobs of the other row, and further comprising a raised, continuous barrier in the form of a bar between the two rows extending lengthwise linearly coextensively with the two rows at least from the first rotary knob beginning each respective row to the last rotary knob of each respective row and extending upright from the plate member to a height sufficient to prevent accidental actuation of a rotary knob in one row during actuation of rotary knob in the other row, said bar having respective sides each said side facing a respective said row and, each said side having a plurality of recesses formed therein each corresponding to and facing a rotary knob of the respective row for accomodating the finger of the operator therein during actuation of a rotary knob.

2. A structure as defined in claim 1, wherein said recesses are formed as a series of inclined surfaces which are formed in each side of said bar laterally offset from the inclined surfaces of the other side.

3. A structure as defined in claim 1, wherein the rotary knobs of each row are uniformly spaced and arranged to overlap the lateral positions of the rotary knobs of the other row.

4. A structure as defined in claim 3, wherein said recesses are formed as inclined surfaces which are formed in each side of said bar laterally offset from the inclined surfaces of the other side.

5. A structure as defined in claim 1, wherein said bar is formed integrally as a part of the plate member.

* * * * *